US006922924B2

(12) United States Patent
Jones et al.

(10) Patent No.: US 6,922,924 B2
(45) Date of Patent: Aug. 2, 2005

(54) PLOW CUTTING EDGE

(75) Inventors: Jayson D. Jones, Madison, WI (US); Jeff J. Smith, Waunakee, WI (US)

(73) Assignee: Burke Truck & Equipment, Inc., Madison, WI (US)

( * ) Notice: Subject to any disclaimer, the term of this patent is extended or adjusted under 35 U.S.C. 154(b) by 52 days.

(21) Appl. No.: 10/687,003

(22) Filed: Oct. 16, 2003

(65) Prior Publication Data

US 2004/0177534 A1 Sep. 16, 2004

Related U.S. Application Data

(60) Provisional application No. 60/453,619, filed on Mar. 11, 2003.

(51) Int. Cl.[7] ..... E02F 9/28
(52) U.S. Cl. ..... 37/449; 37/457; 172/772.5
(58) Field of Search ..... 37/446, 449, 447, 37/455, 456, 457, 458; 172/772.5, 811, 817

(56) References Cited

U.S. PATENT DOCUMENTS

| | | | |
|---|---|---|---|
| 520,479 | A | 6/1894 | Bunnell |
| 1,543,222 | A | 6/1925 | McVeety |
| 2,061,585 | A | 11/1936 | Meyer |

(Continued)

FOREIGN PATENT DOCUMENTS

| | | | |
|---|---|---|---|
| DE | 3205973 | A1 | 9/1983 |
| FR | 1243526 | | 10/1960 |
| FR | 1255480 | | 9/1983 |
| GB | 1058602 | | 2/1967 |
| SU | 751891 | | 7/1980 |

*Primary Examiner*—Victor Batson
(74) *Attorney, Agent, or Firm*—DeWitt Ross & Stevens S.C.; Craig A. Fieschko, Esq.

(57) ABSTRACT

A plow moldboard cutting edge includes a cutting edge blade having a front (leading) face and a rear (trailing) face, with one or more receiving apertures defined therebetween. An elastic bushing is then provided in each of the receiving apertures of the cutting edge blade, with each bushing having a through hole defined therein. The cutting edge blade is then fastened to the lower edge of a plow moldboard by extending fasteners through cutting edge mounting holes defined in the plow moldboard adjacent its lower edge, and then into the through holes of the bushings. The fasteners secure the bushings to the plow moldboard, and thereby mount the cutting edge blade (which is situated about the elastic bushings) to the plow moldboard as well, with the elastic bushings elastically spacing the cutting edge blade from the fasteners. As a result, when the cutting edge blade is driven along a roadway or other surface to be plowed, the elastic bushings elastically suspend the cutting edge blade from the moldboard so that the cutting edge blade rides along the plowing surface and better conforms to the plowing surface's contour. The elastic bushings additionally help to avoid shock transmission between the cutting edge blade and moldboard, and assist in reducing wear on the cutting edge blade.

36 Claims, 1 Drawing Sheet

U.S. PATENT DOCUMENTS 3,477,149 A 11/1969 Wagner
3,520,076 A 7/1970 Nichols
3,529,677 A 9/1970 Stephenson
3,888,027 A 6/1975 Toews
3,934,654 A 1/1976 Stephenson et al.
3,984,929 A * 10/1976 Meyer et al. ..... 37/449
4,074,449 A * 2/1978 Lanz et al. ..... 228/114
4,288,932 A 9/1981 Küper
4,347,677 A 9/1982 Küper
4,457,380 A * 7/1984 Curry ..... 172/701.3
4,590,694 A 5/1986 Block
4,715,450 A 12/1987 Hallissy et al.
4,770,253 A 9/1988 Hallissy et al.
4,854,112 A * 8/1989 Holley et al. ..... 56/6
4,976,054 A 12/1990 Jones
5,140,763 A 8/1992 Nichols, IV
5,224,555 A 7/1993 Bain et al.
5,437,113 A 8/1995 Jones
5,471,770 A 12/1995 Ferreira
5,501,402 A 3/1996 Jones
5,525,114 A * 6/1996 Gehrke ..... 474/207
5,611,157 A 3/1997 Ferreira
5,743,032 A 4/1998 Vauhkonen
5,746,017 A 5/1998 Marvik
5,778,572 A 7/1998 Lukavich et al.
5,809,672 A 9/1998 Jones
5,813,474 A 9/1998 Manway
5,819,443 A 10/1998 Winter
5,881,480 A 3/1999 Fall
6,003,617 A 12/1999 McSweeney et al.
6,125,559 A 10/2000 Mullenhour
6,202,327 B1 3/2001 Fuller et al.
6,240,659 B1 * 6/2001 Curtis et al. ..... 37/236
6,240,663 B1 * 6/2001 Robinson ..... 37/458
6,269,556 B1 8/2001 Källqvist
6,408,547 B1 6/2002 Jones et al.
6,581,307 B1 6/2003 Jones et al.
6,848,203 B2 * 2/2005 Hohmann et al. ..... 37/446

* cited by examiner

PLOW CUTTING EDGE

CROSS-REFERENCE TO RELATED APPLICATIONS

This application claims priority under 35 USC §119(e) to U.S. Provisional Patent Application 60/453,619 filed 11 Mar. 2003, the entirety of which is incorporated by reference herein.

FIELD OF THE INVENTION

This document concerns an invention relating generally to plowing blades, and more specifically to the cutting edge of a plowing blade (at which the blade rides along the surface being plowed).

BACKGROUND OF THE INVENTION

Plowing action in a snowplow (or other type of plow) is generally effected by the plowing vehicle's moldboard, the (usually curved) shovel-like blade situated in front of the plowing vehicle. At the lower edge of the moldboard, a sacrificial cutting edge is usually provided—a strip of hardened steel, generally carbide steel, which is bolted to the bottom of the moldboard and which is intended to bear the brunt of the wear (rather than the moldboard itself) as the cutting edge scrapes along the roadway. Exemplary cutting edges can be seen, for example, in U.S. Pat. Nos. 3,477,149; 3,888,027; and 4,590,694. In some cases, cutting edges may take forms other than blades, e.g., they may assume wedge or block shapes, as in U.S. Pat. Nos. 1,543,222; 5,471,770; and 5,611,157; or they may assume the form of flexible teeth, as in U.S. Pat. Nos. 5,140,763 and 5,819,443; or the form of a flexible strip, as in U.S. Pat. No. 2,061,585.

Because such cutting edges wear quickly—they may require replacement in no more than about 100 hours of plowing—there is a significant desire in the road machinery industry to develop ways to reduce cutting edge wear and replacement cost/time. Cutting edges are sometimes protected against impact damage by hinging them to the bottom of the moldboard and then biasing them with springs (as in U.S. Pat. No. 5,437,113), elastic elements (as in U.S. Pat. Nos. 4,347,677; 4,288,932; 5,743,032; 6,125,559; and 6,269,556, as well as in UK Patent GB1058602; Soviet patent SU751891; and French patent FR1243526), or a combination of these (as in German publication DE3205973A1) to remain in their operative position until an object (such as a curb) is struck, in which case the cutting edge will temporarily fold back, to return when the load is relieved. However, these "trip" cutting edge arrangements merely protect against impact damage; ordinary wear from scraping against the roadway is not relieved. Apart from generating undesirable costs from the standpoint of the material cost of blade replacement, the need to replace a worn cutting edge also generates significant costs in terms of lost usage of plowing vehicles, and time lost by plowing personnel to maintenance rather than to plowing operations. In the snowplowing field, where the economic cost of unplowed roads (and the resulting delays in transportation and commerce) can be very significant, lost time is a critical concern. One approach that is often taken is to provide replaceable "teeth" or inserts, often made of specially-chosen materials, at the bottom of the cutting edge so that the teeth can be replaced as they wear. See, e.g., U.S. Pat. Nos. 3,529,677; 3,934,654; 4,715,450; 4,770,253; 5,224,555; 5,778,572; 5,813,474; 5,881,480; 6,003,617; and 6,202,327. While these often allow a cutting edge to last longer, they may nevertheless exacerbate disadvantages in replacement costs and maintenance time.

A hybrid approach is presented by U.S. Pat. No. 5,746,017 to Marvik, wherein the cutting edge is segmented into a number of individual "shares," and the shares are then embedded side-by-side in an elastomeric mass which is in turn bolted to the lower edge of the moldboard. In effect, the shares resemble a series of "teeth" protruding from an elastomeric "gum" at the bottom of the moldboard. As the shares scrape along the ground, their elastomeric mounting allows each to slightly give when road irregularities are encountered. According to distributors of this type of cutting edge—which is sometimes referred to as the JOMA cutting edge—good snow and ice removal is obtained, and at the same time the shares experience less wear. Wear on the roadway is also reduced, which is an important consideration owing to the cost of replacing scraped-away markings on the roadway, etc. Another advantage reported by users of this type of cutting edge is that the cutting edge transmits substantially less road vibration to the frame and cab of the plowing vehicle, which also results in decreased vehicle wear and maintenance (and is also far less taxing on the plowing vehicle's operator during plowing operations).

However, a significant disadvantage of the JOMA cutting edge is its cost: the expense of generating the multi-part segments or "shares," and embedding them within an elastomer mount, is significantly greater than the cost of a standard one-piece, all metal cutting edge. Replacement costs can also be effectively exacerbated since when the cutting edge loses one of its "teeth" (shares), the entire length requires replacement for effective cleaning of the surface being plowed. Therefore, it would be useful to have available other cutting edges which obtain results at least comparable to the JOMA, at lesser cost.

SUMMARY OF THE INVENTION

The invention involves a cutting edge which is intended to at least partially solve the aforementioned problems. To give the reader a basic understanding of some of the advantageous features of the invention, following is a brief summary of preferred versions of the cutting edge. As this is merely a summary, it should be understood that more details regarding the preferred versions may be found in the Detailed Description set forth elsewhere in this document. The claims set forth at the end of this document then define the various versions of the invention in which exclusive rights are secured.

A plow moldboard cutting edge includes a cutting edge blade having a front (leading) face and a rear (trailing) face, with one or more receiving apertures defined therebetween. An elastic bushing is then provided in each of the receiving apertures of the cutting edge blade, with each bushing having a through hole defined therein. The cutting edge blade is then fastened to the lower edge of a plow moldboard by extending fasteners through cutting edge mounting holes defined in the plow moldboard adjacent its lower edge, and then into the through holes of the bushings. The fasteners secure the bushings to the plow moldboard, and thereby mount the cutting edge blade (which is situated about the elastic bushings) to the plow moldboard as well, with the elastic bushings elastically spacing the cutting edge blade from the fasteners. As a result, when the cutting edge blade is driven along a roadway or other surface to be plowed, the elastic bushings elastically suspend the cutting edge blade from the moldboard so that the cutting edge blade rides along the plowing surface and better conforms to the plowing surface's contour. The elastic bushings additionally help to avoid shock transmission between the cutting edge blade and moldboard, and assist in reducing wear on the cutting edge blade.

If the elastic bushings and/or fasteners do not by themselves retain the cutting edge blade on the plow moldboard, a mounting member (e.g., an elongated bar or other member sized to maintain each elastic bushing within its receiving aperture) may be situated adjacent the cutting edge blade so that the cutting edge blade is situated between the mounting member and the moldboard. The mounting member may include fastening holes defined therein so that the fasteners extend through all of the mounting member, the receiving apertures of the cutting edge blade (and the through holes of the elastic bushings therein), and the plow moldboard.

The elastic bushings preferably include nonelastic (e.g., metal) bushings lining their through holes, so that the through holes of the nonelastic bushings effectively define the through holes of the elastic bushings. The lengths of the nonelastic bushings (as measured along the axes of their through holes) are preferably greater than the thicknesses of the elastic bushings (as measured in the same dimension) so that the nonelastic bushings help hold the moldboard and any mounting member in spaced relationship, and maintain some small amount of space between these components and the elastic bushings. The elastic bushings may therefore elastically displace during plowing operations without being held against the moldboard (and/or any mounting member), so that they do not bind or rapidly wear.

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
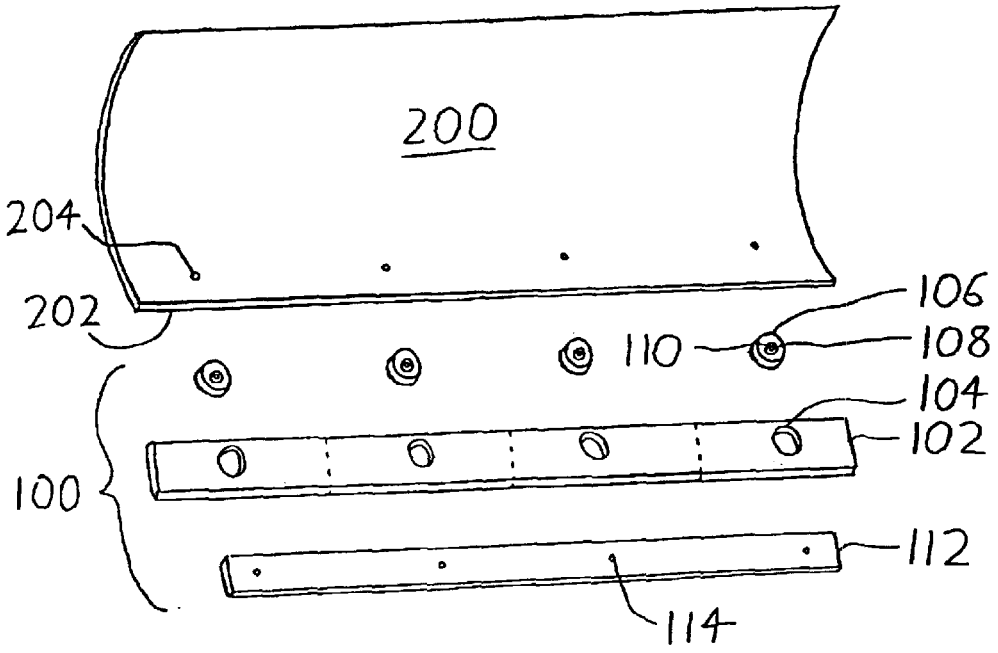
FIG. 1 is a front exploded perspective view of an exemplary version of the invention.
Figure 2:
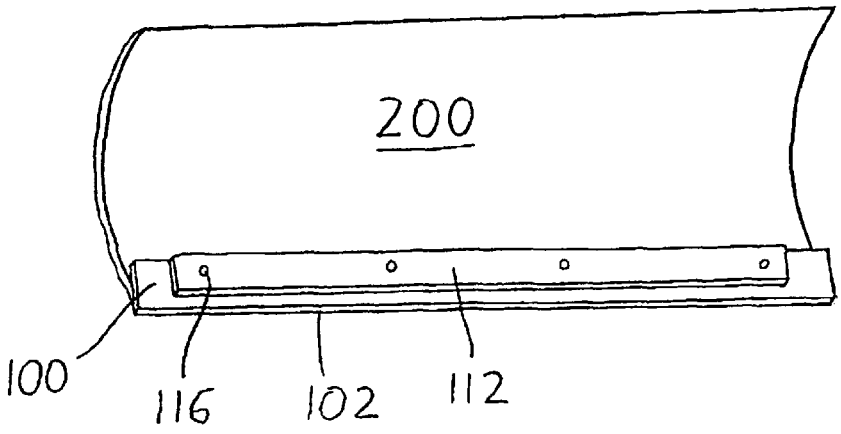
FIG. 2 is a front perspective view of the assembled invention of FIG. 1.

A preferred version of the invention is depicted in the accompanying drawings. Referring initially to the exploded assembly view of FIG. 1, a moldboard 200 has a lower edge 202 along which are spaced a number of cutting edge mounting holes 204. A cutting edge 100 then includes:

(1) A cutting edge blade 102, which is generally similar to a standard cutting edge save that it has a number of receiving apertures 104 defined along its length, each receiving aperture 104 being generally coaxial with one of the cutting edge mounting holes 204 on the lower edge 202 of the moldboard 200;

(2) A number of elastic bushings 106, each of which has an outer diameter sized to be closely received within one of the receiving apertures 104, and an inner diameter lined with a metal bushing 108 with a through hole 110 sized similarly to a cutting edge mounting hole 204; and (3) A mounting member 112, shown in FIGS. 1 and 2 in the exemplary form of a plate, which has a number of mounting member fastening holes 114 spaced thereon, each fastening hole 114 being generally coaxial with one of the cutting edge mounting holes 204 (and one of the bushing through holes 110 when the elastic bushings 106 are installed in the receiving apertures 104).

During assembly, the elastic bushings 106 are each fit within a receiving aperture 104 within the cutting edge blade 102. The cutting edge blade 102 is then situated against the moldboard 200, and the mounting member 112 is then situated atop the cutting edge blade 102 so that fasteners (shown only in FIG. 2 at 116) can be extended through the mounting member fastening holes 114, the bushing through holes 110, and then through the cutting edge mounting holes 204, so that the arrangement appears as depicted in FIG. 2.

As a result of the foregoing arrangement, the cutting edge blade 102 is sandwiched between the moldboard 200 and the mounting member 112, which are maintained in spaced relationship by the metal bushings 108 (but held together by the fasteners 116). However, the cutting edge blade 102 is elastically suspended from the moldboard 200 and the mounting member 112 by the elastic bushings 106, allowing the cutting edge blade 102 to elastically displace along a plane between the moldboard 200 and the mounting member 112. It is also preferred that the metal bushings 108 have lengths (as measured along their axes) slightly longer than the axial lengths (or thicknesses) of the elastic bushings 106 (which preferably have the same thickness as the cutting edge blade 102). For example, the metal bushings 108 may have 13/16" lengths and the elastic bushings 106 may have axial lengths (thicknesses) of ¾", so that the metal bushings 108 each extend axially outwardly by 1/16" from the elastic bushings 106 (e.g., 1/32" on each side of the elastic bushings 106). As a result, when the metal bushings 108 are each sandwiched between the mounting member 112 and the moldboard 200, the elastic bushings 106 and the cutting edge blade 102 have 1/16" of "play" between the mounting member 112 and the moldboard 200.

As a result of the foregoing arrangement, when the cutting edge 100 is scraped along the ground, the cutting edge blade 102 may deflect along its plane (i.e., radially about the bushings 106 and 108), as well as slightly forwardly or backwardly (i.e., it may rotate out of its plane by a small amount). Transmission of road vibrations is greatly decreased, and additionally the life of the cutting edge blade 102 is greatly increased. Where the cutting edge blade 102 is made of carbide steel, it has been found that wear is no longer of the catastrophic mode experienced when the blade is simply bolted to the moldboard—the blade does not chip away in pieces—and rather it more slowly wears away abrasively. Since the entire cutting edge 100 involves no additional assembly steps above that of ordinary cutting edges, save for the insertion of the elastic bushings 106 within the receiving apertures 104, assembly/disassembly time is not disadvantageously increased over standard arrangements. Additionally, the arrangement is far less expensive to manufacture than prior competing arrangements.

The description set out above is merely of one exemplary preferred version of the invention, and it is contemplated that numerous additions and modifications can be made. Following are additional examples.

First, the elastic bushings 106 need not be circular/cylindrical in shape, and may take other forms; and while the interior metal bushing 108 is preferred, it is not necessary. Thus, as an example, the elastic bushings 106 might simply take the form of elastomeric cubes each having a through hole 110 drilled through it, with each cube fitting within a complementary receiving aperture 104 in the cutting edge blade 102.

Second, the mounting member 112 need not be formed as a plate. As an example, the mounting member 112 might instead be provided as a large washer, with each of the bushings 106 having such a washer-like mounting member 112 adjacently situated with a fastener 116 extending through the mounting member 112, the bushing 106, and the moldboard 200 so that each such mounting member 112

(which is preferably sized larger than the receiving aperture 104 of its adjacent bushing 106) holds the cutting edge blade 102 adjacent the moldboard 200, and holds its adjacent bushing 106 within its receiving aperture 104. Further, the mounting member 112 is not essential, and other arrangements might be used to maintain the bushings 106/108 (and the cutting edge blade 102) against the moldboard 200. As an example, each of the elastic bushings 106 might be provided with its own radially-extending lip at one axial end, with the lip preventing its elastic bushing 106 from passing entirely through its receiving aperture 104. Each elastic bushing 106 can then simply be fastened within its receiving aperture 104, with the cutting edge blade 102 being sandwiched between the moldboard 200 and the lip of the elastic bushing 106.

Third, the cutting edge blade 102 can be segmented into multiple "teeth," as exemplified by the proposed separation lines shown (in phantom) along the cutting edge blade 102 in FIG. 1.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A plow moldboard cutting edge comprising:

a. cutting edge blade having one or more receiving apertures defined therein:

b. one or more elastic bushings, each bushing:

(1) having a through hole defined therein, and (2) being situated within one of the receiving apertures, c. a mounting member adjacent the cutting edge blade and at least one of the receiving apertures defined therein, wherein the mounting member:

(1) is sized greater than the adjacent receiving apertures, and (2) has at least one fastening hole defined therein, with the fastening hole being aligned with one of the receiving apertures, whereby fasteners may he inserted through the fastening holes of the mounting member, the through holes of the bushings, and into a plow moldboard to affix the cutting edge blade to the plow moldboard, with the bushings thereby spacing the cutting edge blade from the fasteners within the receiving apertures.

2. The plow moldboard cutting edge of claim 1 wherein the mounting member is elongated to extend along a length of the cutting blade.

3. The plow moldboard cutting edge of claim 2 wherein the mounting member is adjacent at least two of the receiving apertures, and extends therebetween.

4. The plow moldboard cutting edge of claim 1 wherein the mounting member is defined by an elongated bar extending adjacent to and between the receiving apertures.

5. The plow moldboard cutting edge of claim 1 wherein:

a. each of the elastic bushings includes a nonelastic bushing therein, and b. the through hole is defined in the nonelastic bushing.

6. A plow moldboard cutting edge comprising:

a. a cutting edge having one or more receiving apertures defined therein:

b. one or more elastic bushings, each elastic bushing being situated within one of the receiving apertures, c. one or more nonelastic bushing, each nonelastic bushing being situated within one of the elastic bushings and having a through hole defined therein, wherein the thicknesses of the elastic bushings, as measured along the axes of their through holes, are less than the lengths of the nonelastic bushings as measured along the same axis, whereby fasteners may be inserted through the through holes of the nonelastic bushings and into a plow moldboard to affix the cutting edge blade to the plow moldboard, with the bushings thereby spacing the cutting edge blade from the fasteners within the receiving apertures.

7. The plow moldboard cutting edge of claim 6 further comprising a mounting member adjacent the cutting edge blade and at least one of the receiving apertures defined therein, wherein the mounting member:

a. is sized greater than the adjacent receiving apertures, and b. has at least one fastening hole defined therein, with the fastening hole being aligned with one of the receiving apertures, whereby fasteners may be also inserted through the fastening holes of the mounting member to affix the cutting edge blade to the plow moldboard.

8. The plow moldboard cutting edge of claim 7 wherein the mounting member is elongated to extend along a length of the cutting blade.

9. The plow moldboard cutting edge of claim 8 wherein the mounting member is adjacent at least two of the receiving apertures, and extends therebetween.

10. The plow moldboard cutting edge of claim 7 wherein the mounting member is defined by an elongated bar extending adjacent to and between the receiving apertures.

11. The plow moldboard cutting edge of claim 6 wherein the thickness of the cutting edge blade, as measured along the axes of the receiving apertures, is less than the lengths of the nonelastic bushings as measured along the axes of the through holes in the nonelastic bushings.

12. A plow moldboard cutting edge comprising:

a. cutting edge blade having one or more receiving apertures defined therein:

b. one or more elastic bushings, each elastic bushing being situated within one of the receiving apertures, c. one or more nonelastic bushings, each nonelastic bushing being situated within one of the elastic bushings and having a through hole defined therein, wherein the thickness of the cutting edge blade, as measured along the axes of the receiving apertures, is less than the lengths of the nonelastic bushings as measured along the axes of the through holes in the nonelastic bushings, whereby fasteners may be inserted through the through holes of the nonelastic bushings and into a plow moldboard to affix the cutting edge blade to the plow moldboard, with the bushings thereby spacing the cutting edge blade from the fasteners within the receiving apertures.

13. The plow moldboard cutting edge of claim 12 further comprising a mounting member adjacent the cutting edge blade and at least one of the receiving apertures defined therein, wherein the mounting member:

a. is sized greater than the adjacent receiving apertures, and b. has at least one fastening hole defined therein, with the fastening hole being aligned with one of the receiving apertures, whereby fasteners may be also inserted through the fastening holes of the mounting member to affix the cutting edge blade to the plow moldboard.

14. The plow moldboard cutting edge of claim 13 wherein the mounting member is elongated to extend along a length of the cutting blade.

15. The plow moldboard cutting edge of claim 14 wherein the mounting member is adjacent at least two of the receiving apertures, and extends therebetween.

16. The plow moldboard cutting edge of claim 13 wherein the mounting member is defined by an elongated bar extending adjacent to and between the receiving apertures.

17. The plow moldboard cutting edge of claim 12 the thicknesses of the elastic bushings, as measured along the axes of their through holes, are less than the lengths of the nonelastic bushings as measured along the same axis.

18. A plow moldboard cutting edge comprising:

a. a cutting edge blade having one or more receiving apertures defined therein;

b. one or more elastic bushings, each bushing:
(1) having a through hole defined therein, and
(2) being situated within one of the receiving apertures, c. a plow moldboard with one or more cutting edge mounting holes defined therein, the cutting edge mounting holes being adjacently aligned with the receiving apertures of the cutting edge blade; and d. one or more fasteners, each extending through one of the cutting edge mounting holes and one of the bushings and into the plow moldboard, thereby affixing the cutting edge blade to the plow moldboard, with the bushings thereby spacing the cutting edge blade from the fasteners within the receiving apertures.

19. The plow moldboard cutting edge of claim 18 further comprising a mounting member adjacent the cutting edge blade and at least one of the receiving apertures defined therein, wherein the mounting member:

a. is sized greater than the adjacent receiving apertures, and b. has at least one fastening hole defined therein, with the fastening hole being aligned with one of the receiving apertures, whereby fasteners may be also inserted through the fastening holes of the mounting member to affix the cutting edge blade to the plow moldboard.

20. The plow moldboard cutting edge of claim 19 wherein the mounting member is elongated to extend along a length of the cutting blade.

21. The plow moldboard cutting edge of claim 20 wherein the mounting member is adjacent at least two of the receiving apertures, and extends therebetween.

22. The plow moldboard cutting edge of claim 19 wherein the mounting member is defined by an elongated bar extending adjacent to and between the receiving apertures.

23. The plow moldboard cutting edge of claim 18 wherein the thickness of the cutting edge blade, as measured along the axes of the receiving apertures, is less than the lengths of the nonelastic bushings as measured along the axes of the through holes in the nonelastic bushings.

24. The plow moldboard cutting edge of claim 18 wherein the thickness of the elastic bushings, as measured along the axes of their holes, are less than the lengths of the nonelastic bushings us measured along the same axis.

25. A plow moldboard cutting edge comprising:

a. a plow moldboard having a lower edge, with a cutting edge mounting hole situated adjacent the lower edge;

b. a cutting edge blade at the lower edge of the plow moldboard, the cutting edge blade having a receiving aperture defined therein, the receiving aperture being aligned with the cutting edge mounting hole;

c. a fastener extending through the cutting edge mounting hole in the plow moldboard and the receiving aperture in the cutting edge blade;

d. an elastic bushing situated within the receiving aperture in the cutting edge blade, the elastic bushing having a through hole through which the fastener extends, whereby the elastic bushing is interposed between the cutting edge blade and the fastener.

26. The plow moldboard cutting edge of claim 25 wherein the elastic bushing has a nonelastic bushing situated therein, and wherein the through hole is defined within the nonelastic bushing.

27. The plow moldboard cutting edge of claim 26 wherein:

a. the elastic bushing has a thickness defined along the axis of the through hole;

b. the nonelastic bushing has a length defined along the axis of the through hole; and c. the length of the nonelastic bushing is greater than the thickness of the elastic bushing.

28. The plow moldboard cutting edge of claim 25 wherein:

a. the elastic bushing has a nonelastic bushing situated therein, with the through hole being defined within the nonelastic bushing;

b. the cutting edge blade has a thickness defined along the axis of its receiving aperture;

c. the nonelastic bushing has a length defined along the axis of the through hole; and d. the length of the nonelastic bushing is greater than the thickness of the cutting blade.

29. The plow moldboard cutting edge of claim 25 further comprising a mounting member situated adjacent the cutting edge blade, wherein:

a. the cutting edge blade is situated between the mounting member and the plow moldboard, b. the mounting member is sized to retain the elastic bushing in the receiving aperture between the mounting member and the plow moldboard; and c. the fastener additionally extends through the mounting member.

30. The plow moldboard cutting edge of claim 29 wherein mounting member is elongated to extend along a length of the cutting edge blade.

31. A plow moldboard cutting edge comprising:

a. a plow moldboard having a lower edge, with a cutting edge mounting hole situated adjacent the lower edge;

b. a cutting edge blade situated adjacent the plow moldboard, the cutting edge blade having a receiving aperture defined therein with the receiving aperture aligned with the cutting edge mounting hole;

c. an elastic bushing:
(1) situated within the receiving aperture, and
(2) having a through hole defined therein;

d. a mounting member situated adjacent the receiving aperture of the cutting edge blade, with:
(1) the cutting edge blade and elastic bushing being situated between the mounting member and the plow moldboard, and
(2) the mounting member being sized to maintain the elastic bushing within the receiving aperture of the cutting edge blade;

e. a fastener extending through:
(1) the mounting member,
(2) the receiving aperture of the cutting edge blade and the through hole of the elastic bushing therein, and
(3) the plow moldboard.

32. The plow moldboard cutting edge of claim 31 further comprising a nonelastic bushing extending through the elastic bushing between the mounting member and the plow moldboard.

33. The plow moldboard of claim 32 wherein:

a. the nonelastic bushing and the elastic bushing each have a thickness measured between the mounting member and the plow moldboard, and b. the thickness of the nonelastic bushing is greater than the thickness of the elastic bushing.

34. The plow moldboard cutting edge of claim 31 further comprising a nonelastic bushing lining the through hole of the elastic bushing.

35. The plow moldboard cutting edge of claim 31 wherein the mounting member is elongated, and extends along a length of the cutting edge blade.

36. A plow moldboard cutting edge comprising:

a. a cutting edge blade having one or more receiving apertures defined therein;

b. one or more elastic bushings, each bushing:
(1) having a through hole defined therein, and
(2) being situated within one of the receiving apertures, c. a plow moldboard having a lower edge, with one or more cutting edge mounting holes:
(1) situated adjacent the lower edge, and
(2) aligned with the receiving apertures;

d. one or more mounting members, each being:
(1) situated adjacent at least one of the receiving apertures of the cutting edge blade, with the cutting edge blade being situated between the mounting member and the plow moldboard, and
(2) sized greater than any adjacent receiving aperture, whereby the mounting member will maintain the elastic bushing therein;

e. fasteners extending through:
(1) the mounting members,
(2) the receiving apertures of the cutting edge blade and the through holes of the elastic bushings therein, and
(3) the plow moldboard, with the bushings thereby spacing the cutting edge blade from the fasteners within the receiving apertures.

* * * * *